US005566404A

United States Patent [19]

Laughton

[11] Patent Number: 5,566,404

[45] Date of Patent: Oct. 22, 1996

[54] SINK WITH WHEELCHAIR ACCESS

[75] Inventor: John Laughton, Polegate, England

[73] Assignee: American Standard Inc., Piscataway, N.J.

[21] Appl. No.: 473,624

[22] Filed: Jun. 7, 1995

Related U.S. Application Data

[62] Division of Ser. No. 406,821, Mar. 20, 1995, abandoned, which is a continuation of Ser. No. 122,875, Sep. 16, 1993, abandoned.

[30] Foreign Application Priority Data

Jun. 25, 1993 [GB] United Kingdom ..... 9313140

[51] Int. Cl.[6] ..... A47K 1/04

[52] U.S. Cl. ..... 4/619; 4/650; 4/631

[58] Field of Search ..... 4/619, 630, 631, 4/650

[56] References Cited

U.S. PATENT DOCUMENTS

| | | | |
|---|---|---|---|
| D. 45,284 | 2/1914 | Alpaugh . | |
| D. 76,700 | 10/1928 | Nash . | |
| D. 95,378 | 4/1935 | Morgan . | |
| D. 172,707 | 7/1954 | Farrar . | |
| D. 194,021 | 11/1962 | Chapman . | |
| D. 252,100 | 6/1979 | Morris et al. | 23/58 |
| D. 319,493 | 8/1991 | Edmondson | 23/284 |
| D. 321,753 | 11/1991 | Bengtson et al. | 23/284 |
| 2,028,802 | 1/1936 | Ottke | 4/630 |
| 2,185,186 | 1/1940 | Coordes | 4/166 |
| 2,210,933 | 8/1940 | Graf | 113/120 |
| 2,583,922 | 1/1952 | Zummach . | |
| 2,767,407 | 10/1956 | Weiss . | |
| 2,818,581 | 1/1958 | Miller | 4/630 |
| 2,841,799 | 7/1958 | Traynor . | |
| 3,508,282 | 4/1970 | Phillips, Jr. | 4/630 |
| 4,193,141 | 3/1980 | Rosenberg et al. . | |
| 4,295,233 | 10/1981 | Hinkel et al. . | |
| 4,462,126 | 7/1984 | Cleaveland . | |
| 4,991,241 | 2/1991 | Bergmann et al. | 4/619 |
| 5,016,297 | 5/1991 | Sauter et al. | 4/619 |

FOREIGN PATENT DOCUMENTS

| | | | |
|---|---|---|---|
| 2542344 | 9/1984 | France | 4/619 |

OTHER PUBLICATIONS

Ingersoll–Humphreys Division, Borg Warner Corp. Brochure Oct. 7, 1964, p. 2 "Carroll" & Earlham Lavatories. Kohler Catalogue "Boutique Countertop" and Pennington Countertop pp. 13–21, 1990.

*Primary Examiner*—Renee S. Luebke
*Assistant Examiner*—Charles R. Eloshway
*Attorney, Agent, or Firm*—Elaine Brenner Robinson; Ann M. Knab

[57] ABSTRACT

A sink for disabled persons. The sink is designed for use in the kitchen or in the bathroom. It includes at least one wide side ledge adequate for the placement of a faucet assembly, alleviating the problems associated with rear ledge faucet assembly placement. The bottom of the sink is designed to accommodate one in a wheelchair or sitting position.

12 Claims, 5 Drawing Sheets

SINK WITH WHEELCHAIR ACCESS

This is a division of a continuation application Ser. No. 08/406,821 filed Mar. 20, 1995 now abandoned which is a continuation of application Ser. No. 08/122,875 filed on Sep. 16, 1993 for Sink With Wheelchair Access now abandoned.

FIELD OF THE INVENTION

The present invention relates generally to sinks, and particularly to bathroom and kitchen sinks designed for use by physically challenged persons.

BACKGROUND OF THE INVENTION

Sinks for use by physically challenged persons were traditionally constructed in conformance with the guidelines issued by the American National Standards Institute (ANSI) and additional state enacted legislation. Included in these requirements are minimum and maximum mounting heights for the sink, maximum depth of the sink basin and specific pipe configuration under the sink. Although these regulations proved beneficial to the physically disabled, private businesses and public facilities were not obligated to accommodate the physically challenged by installing and providing ANSI regulated sanitaryware fixtures on their premises.

Consequently, the Americans With Disabilities Act (ADA) was enacted in 1992. In addition to setting forth guidelines similar to ANSI guidelines for construction and installation of sanitaryware (among other things), the ADA prohibits discrimination against physically challenged persons resulting from facilities in public areas and private places of business. In complying with the ADA, businesses and public facilities will be obligated to install sanitaryware designed to accommodate the physically challenged, thereby increasing the need for a more universal design equally adaptable for persons with and without physical disabilities.

In accordance with the ADA, the counter surface or rim of the sink must be positioned at a maximum height of 34 inches (865 mm) above the floor. The area below the sink measured from the bottom of the apron of the sink must be no less than 29 inches (735 mm) above the floor. The specified dimensions allow for an easy approach to the sink and provide suitable knee and toe clearance for a person in a wheelchair.

To increase convenience and efficiency of ANSI and/or ADA regulated sinks, many sinks have been designed with beneficial features in addition to the requisite conditions mandated by ANSI regulations and the ADA. U.S. Pat. No. 4,193,141 discloses a bathroom sink or lavatory for disabled persons having a concave front wall and semi-circular recesses for receiving elbows of a person, easing the task of washing for a person in a sitting position. U.S. Pat. No. 4,462,126 discloses a sink for a seated user including a recess for receiving the feet, knees, shins and lap front of a person seated frontally of the sink.

The prior art bathroom and kitchen sinks adapted for physically challenged persons provide ample room for wheelchair access to the sink. Unfortunately, even with adequate room to approach the sink, for a person constrained to a wheelchair the simple task of washing one's hands can become quite arduous when one is forced to unduly reach and strain to use the faucet assembly located on the rearward ledge of the sink. This is particularly the case if the user has any weakness or handicap in the arms.

More complex tasks such as washing dishes can become increasingly difficult as the act of continuously turning on and off the faucet becomes necessary. Reaching across the basin of the sink is not only uncomfortable for a person in a wheelchair, but it is also inconvenient for a person unable to stand for long periods of time and desiring to sit and work at the sink when washing dishes, preparing food or the like. Moreover, young children often experience difficulty when having to reach across to the rearward ledge of the sink to turn on and off the faucet assembly. Furthermore, and unfortunately, there is a stigma attached to a sink designed for one having disabilities because it is unique in function and appearance from other sinks which are designed for users without physical handicaps.

None of the related prior art shows in addition to wheelchair access, convenient forward-mounting of the faucet spout and handle. None of the lavatories discuss positioning the faucet assembly in such a way to ease any discomfort when using the faucets. Accordingly, it is desirable to provide a sink with a conveniently located faucet assembly to permit ease and comfort for one unable to easily reach a rearward mounted faucet assembly. Moreover, it is advantageous to design a sink having a universal design equally adaptable for persons with and without physical handicaps, thereby removing the stigma attached to the specially designed handicap sink.

SUMMARY OF THE INVENTION

It is an object of the invention to provide a sink having an accessible forward mounted faucet assembly and a front wall having a narrow ledge providing maximum convenience and feasibility, especially for a person having minimal physical forward extension capabilities.

It is another object of the invention to provide a sink having dimensions conforming to ADA standards.

It is a further object of the invention to provide a sink having at least one wide side ledge and a drain positioned in the rear corner of the bottom floor adjacent the faucet assembly, for efficient connection between faucet and drain.

In accordance with these and other objects of the invention, a sink is provided having at least one side wall with a very wide ledge and a front wall with a very narrow ledge. A faucet assembly is frontally positioned on a side ledge allowing easy access to it. A drain opening is preferably positioned at the rear corner of the bottom floor adjacent the side ledge housing the faucet assembly, in close proximity to the faucet assembly, allowing for efficient drainage of water. The frontal positioning of the faucet assembly maximizes comfort and convenience for a person desiring to use the sink by reducing the distance between the user of the sink and the faucet assembly.

In accordance with one aspect of the invention, the sink is adapted for use in the bathroom and is often referred to as a lavatory. The sink has an inclined bottom floor, sloping upwardly from rearward end to forward end and an integrally formed front wall, the exterior of which is curved convexly to allow ample room for a person approaching the sink, especially for one in a wheelchair or in a sitting position. The basin is of a depth adequate to perform intended tasks, in addition to its conformance to the ADA height and clearance requirements.

The sink may be mounted to a wall by brackets or chair arms. Brackets which are lighter and often used in residential settings, are mounted to the wall and fit into carrying slots at the back of the sink. Chair arms are usually fabricated of metal and are mounted within the wall and fitted into the hollow interior of the sink. Such chair arms are much stronger than brackets and are typically used in commercial environments in accordance with the invention.

In accordance with another aspect of the invention, the sink can be adapted for use in the kitchen. The kitchen sink has a substantially flat bottom floor and is positioned at a height adequate to provide sufficient room for a person in a sitting position to easily approach the sink and position himself within working range of the faucet assembly and basin of the sink. The basin is preferably no more than 6 inches deep, adequate to perform intended tasks, such as washing dishes and the like, while allowing a wheelchair user adequate knee space beneath the bottom floor of the sink basin.

BRIEF DESCRIPTION OF THE DRAWINGS

The invention will be more fully appreciated from the following detailed description when the same is considered in connection with the accompanying drawings in which.

DETAILED DESCRIPTION OF THE INVENTION

Figure 1:
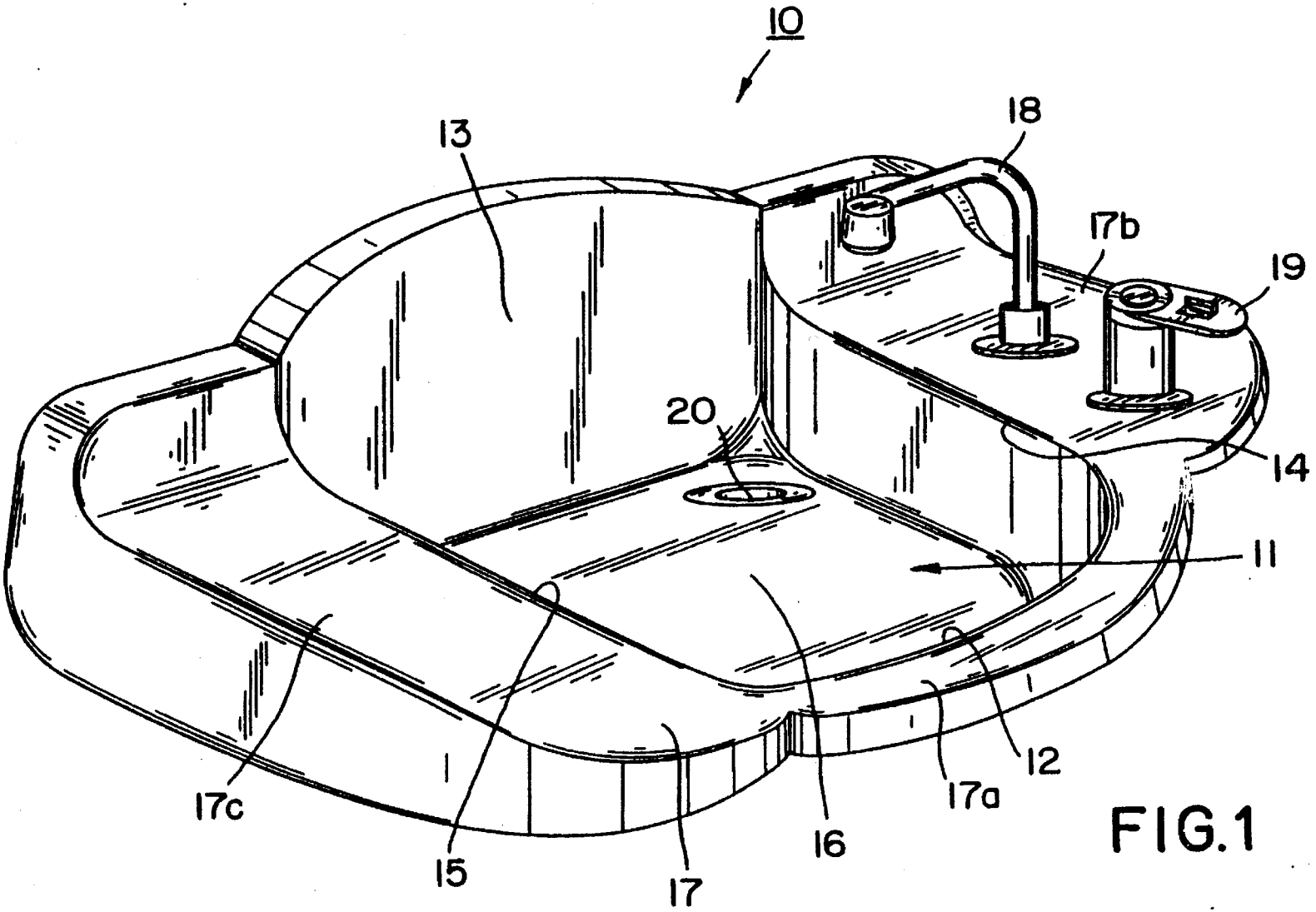
FIG. 1 is a top perspective view showing one embodiment of the sink of the present invention.
Figure 2:
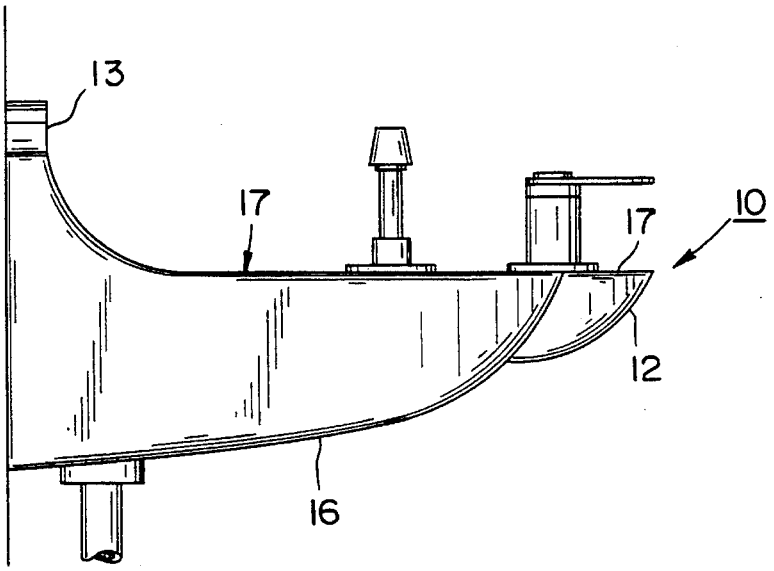
FIG. 2 is a side view of the sink of FIG. 1.
Figure 3:
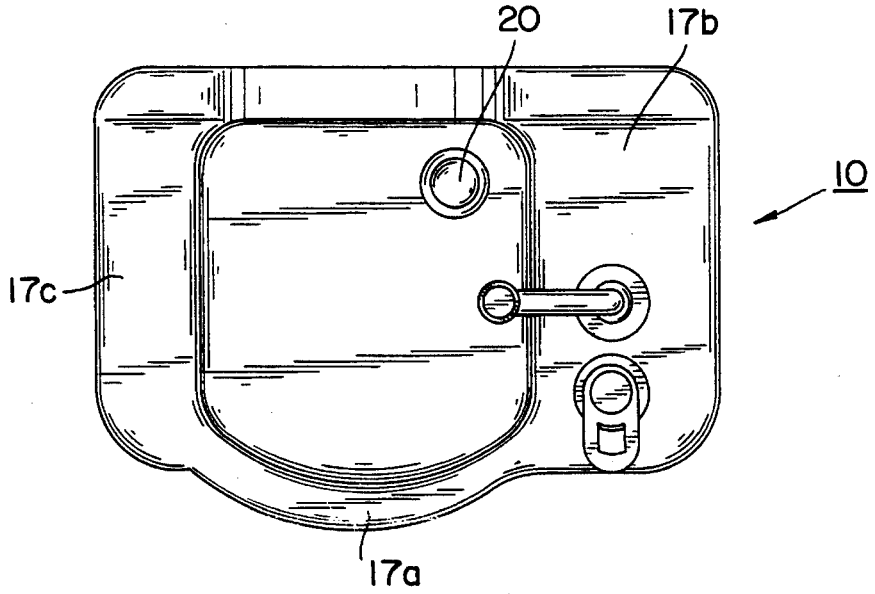
FIG. 3 is a top plan view of the sink of FIG. 1.

A bathroom sink 10 as shown in FIGS. 1 through 3 includes a rectangularly shaped basin 11. The basin 11 includes a curved front wall 12, a rear wall 13, and a first side wall 14 opposite a second side wall 15. A curved bottom floor 16 supports and forms integrally with the front wall, rear wall and side walls. A ledge 17 extends horizontally outwardly from the upper edges of the side walls and front wall of the basin. The front ledge 17*a* extends narrowly along the upper surface of front wall 12 and continues as 17*b* and 17*c* along the upper surfaces of side walls 14 and 15, respectively, at a substantially greater width than the ledge extending along the upper surface of the front wall 12. The front ledge 17*a* is relatively short in length corresponding to the short length of front wall 12 and narrow in width to allow for easy access to the basin 11. The side ledges 17*b* and 17*c* are relatively long and wide and substantially horizontal providing a suitable area for placement of a faucet assembly in addition to shelf space for storage or placement of washing instruments.

FIG. 1 illustrates one embodiment of the invention wherein sink 10 shows a faucet assembly including spout 18 and handle 19 positioned on side ledge 17*b* . Side ledge 17*b* is slightly larger than side ledge 17*c* to adequately provide a mountable surface for the faucet assembly. If left side placement of the faucet assembly is desired, the sink can be designed with side ledge 17*c* having a larger width than shown to sufficiently provide an area for placement of a faucet assembly. Alternatively, the sink can be designed with side ledges of equal but sufficient width to allow for placement of the faucet assembly on either side ledge. This front lateral placement of a faucet assembly facilitates access to the assembly obviating the need to extend oneself forward to use a faucet assembly located on the rear wall or ledge of a sink. Although any desired plumbing fitting may be employed, FIG. 1 displays a gooseneck spout 18 and a lever handle 19.

Ledges 17*b* and 17*c* continue in a substantially horizontal plane to a point adjacent rear wall 13, whereat the ledges extend upwardly, adjacent rear wall 13 and continue vertically to a point below the top edge of rear wall 13 forming an extension of rear wall 13. The top edge of rear wall 13 has a convex curvature and extends above the top surface of ledges 17*a* , 17*b* and 17*c*.

A drain opening 20 lies in the far right corner of bottom floor 16, adjacent the lower edge of rear wall 13 and lower edge of first side wall 14. The drain may be located anywhere on bottom floor 16 although it is preferable that it be positioned in close proximity to the faucet assembly to allow for efficient drainage of water, thereby preventing splashing from heavy water flow. Moreover, a drain pipe fitted within the drain opening will extend proximate the wall to which the sink is attached, providing ample space for knee and toe clearance.

As shown in FIG. 2, the bottom floor 16 is inclined upwardly from rear wall to front wall, and formed integrally with front wall 12, the exterior of which is curved convexly. The curvature defined by bottom floor 16 and front wall 12 is designed to provide ample space for a person in a sitting position, when the sink is mounted.

The sink of the invention is typically mounted on a wall via the exterior surface of rear wall 13 of the sink by any known means such as brackets or chair arms. Following ADA guidelines, the sink is normally positioned at a height of no higher than 34 inches (868 mm) above the floor, measured from the top surface of ledge 17 of the sink and no lower than 29 inches (735 mm) above the floor measured from the bottom edge of ledge 17. It should be noted that to meet individual requirements, the ADA guidelines do not limit where and how the sink is to be mounted. This pertains, in particular, to residential situations where the sink can be mounted at any desirable height and by any known means.

FIG. 3 illustrates the short distance between the faucet assembly and the front ledge of the sink. The drain is located in the far right corner of the bottom floor to decrease backflow in the frontal region of the sink and provide efficient drainage.

Figure 4:
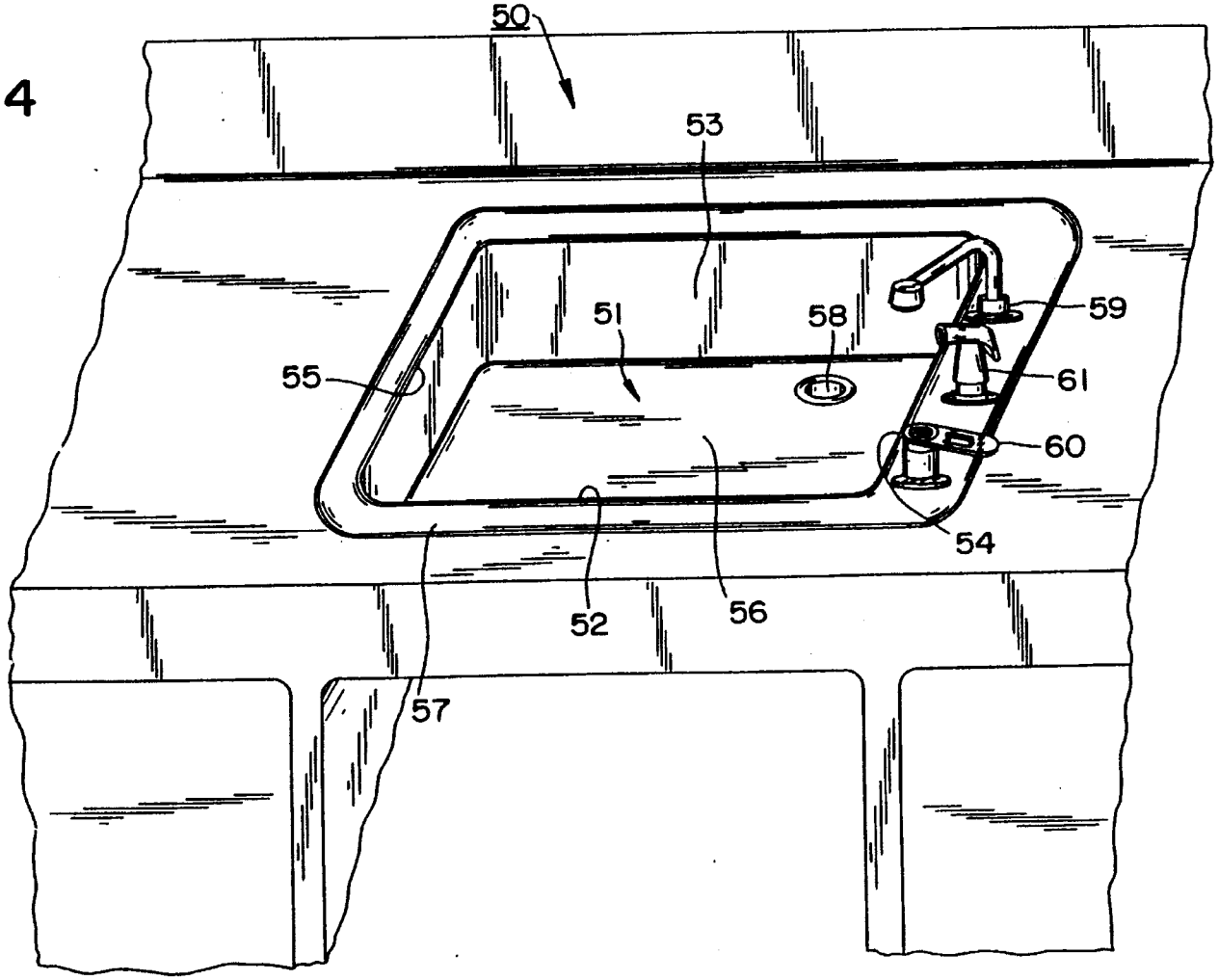
FIG. 4 is a top perspective view showing another embodiment of the sink of the present invention.
Figure 5:
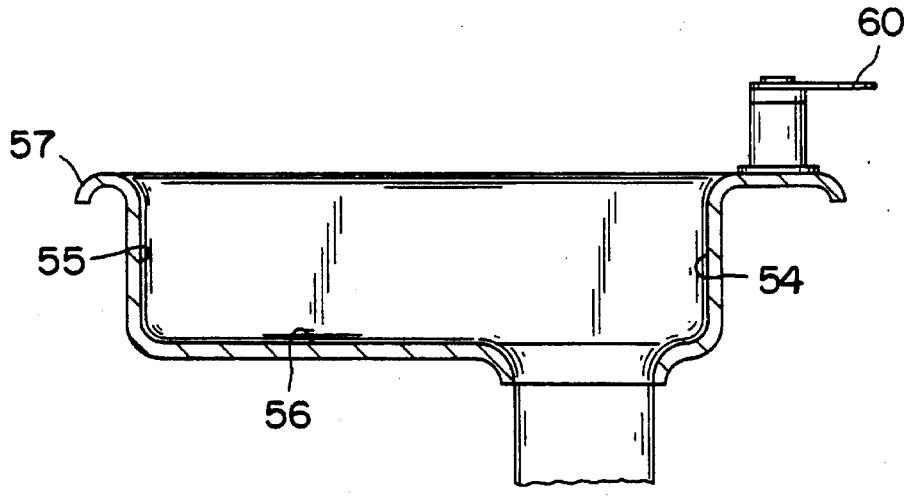
FIG. 5 is a transverse sectional view of the sink of FIG. 4 taken along line 5—5.
Figure 6:
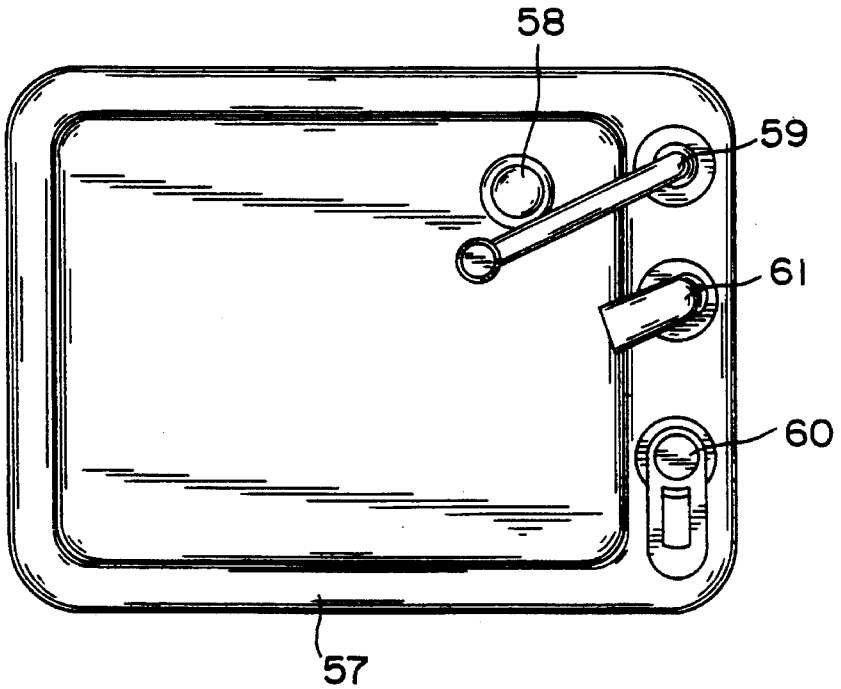
FIG. 6 is a top plan view of the sink of FIG. 4.

FIGS. 4 through 6 are directed to a sink for use in the kitchen. The sink 50 includes a rectangularly shaped basin 51. The basin includes substantially straight front, rear, and first and second side walls, 52, 53, 54, 55, respectively. A substantially flat bottom wall 56 supports and forms integrally with the front, rear and side walls. A ledge 57 extends horizontally outwardly from the upper edges of the four upstanding walls of the basin. The ledge extends narrowly along the upper edges of the front, rear and one of the side walls. The ledge has a much greater width along the remaining side wall 54. A faucet assembly is positioned on the wide right side ledge. This frontal placement of the faucet assembly facilitates access to the assembly.

A drain opening 58 lies in the far right corner of bottom floor 56, adjacent the lower edge of rear wall 53 and the lower edge of first side wall 54. The drain may be located anywhere on bottom floor 56 although it is preferable that it be positioned in close proximity to the faucet assembly to allow for efficient drainage of water, thereby preventing splashing from heavy water flow.

The faucet assembly used in conjunction with the sink of the present invention is not limited to any particular type of faucet but may include a single-hole single-lever faucet, a single lever control valve and swing spout combination, a metering faucet, a dual control faucet, and any faucet in combination with a pull-out spray spout. FIGS. 4 and 6 show a gooseneck spout 59, a lever handle 60 and a pull-out spray spout 61.

Figure 7:
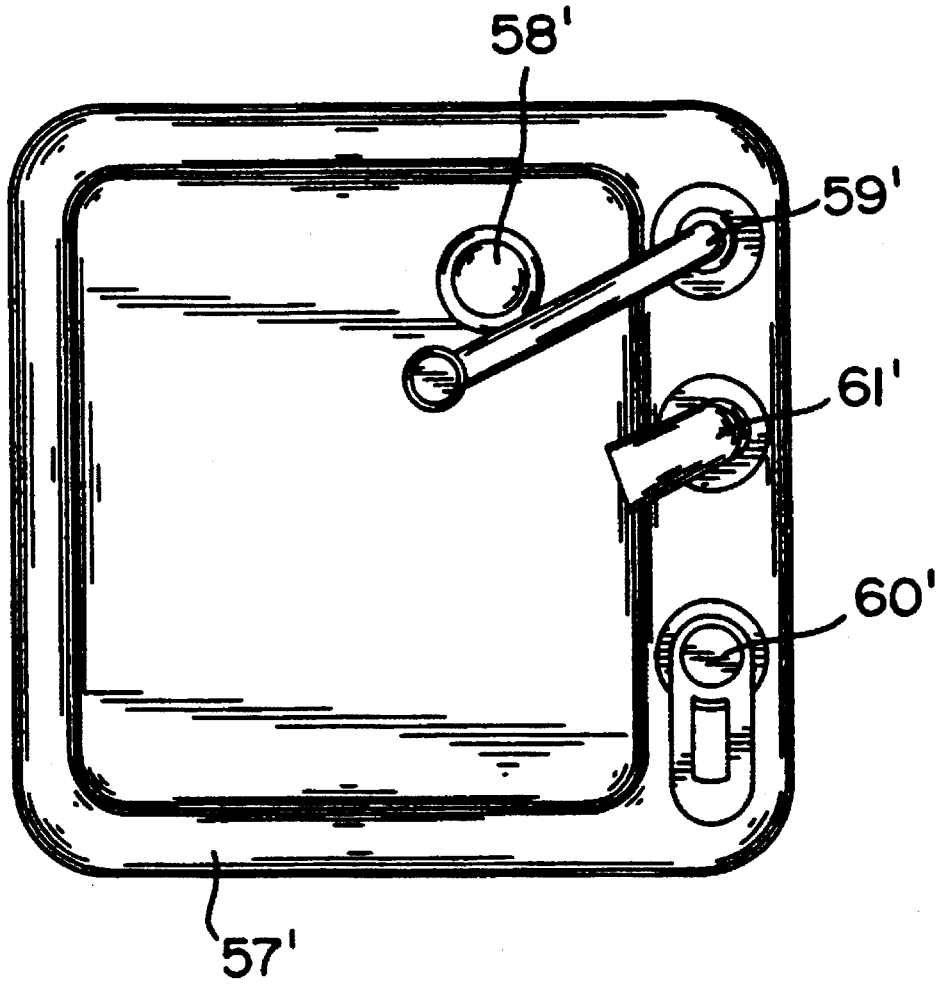
FIG. 7 is a top plan view of a square version of the sink shown in FIGS. 4 through 6.

FIG. 7 is directed to a sink for use in the kitchen which is a square shaped version of the sink shown in FIGS. 4 through 6. The exterior walls of the sink are equal in length allowing for flexible installation. That is, the sink may be installed with the faucet assembly positioned on the side ledge or with the faucet assembly positioned on the rear ledge. As shown, a ledge 57' extends horizontally outwardly from the upper edges of the four upstanding walls of the basin. Included therein is a drain opening 58' lying in the far right corner of the bottom floor. Gooseneck spout 59', lever handle 60' and pull-out spray 61' are disposed on the wide right ledge of the sink. The square version of the kitchen sink allows for dual installation wherein the sink may be installed such that the wide ledge and faucet assembly are positioned on the side or whereat the wide ledge and faucet assembly are positioned in the rear. As a result, a kitchen sink with a universal design is available and equally adaptable for persons with and without physical disabilities. The sinks of the invention are not limited to, but may be constructed of any known sanitaryware materials such as cast iron, steel, vitreous china and Americast™ (an American Standard Inc. trademark) brand, engineered material, a plastic-backed enameled-steel material.

When a person is in need of using the bathroom or kitchen sink, particularly when in a sitting position, he or she can easily position himself or herself within close proximity to the front ledge of the sink. The faucet assembly is laterally accessible from this position, thereby preventing discomfort which occurs when reaching across the basin to use a faucet assembly located at the rearward end of the sink. The sink offers a functionally superior faucet assembly arrangement, allowing ease and comfort during use.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A sink for use in a kitchen comprising:

a rear wall;

a front wall;

a first side wall opposed to a second side wall, said side walls adjoining said front wall and said rear wall;

a bottom floor adjoining lower edges of said rear wall, front wall and side walls, said bottom floor being substantially flat, said rear wall, front wall, side walls and bottom floor defining a basin;

first and second planar ledges extending horizontally outwardly from upper edges of said first and second side walls, respectively;

a faucet assembly mounted on one of said first and second planar ledges, said faucet assembly including a spout and a control handle mounted on one of said planar ledges, said spout having a discharge opening directed downwardly towards said bottom floor into said basin, said control handle positioned proximate and forward of said spout and adjacent and proximate a front edge of said ledge whereby a user can easily access said control handle from the front of the sink, said spout adjacent said handle;

and a drain opening positioned in said bottom floor, said drain opening adjacent a lower edge of said rear wall and a lower edge of one of said side walls.

2. The sink of claim 1 wherein said planar ledge with said faucet assembly mounted thereon is said first planar ledge.

3. The sink of claim 2 wherein said first planar ledge is greater in width than said second planar ledge.

4. The sink of claim 3 further comprising third and fourth planar ledges extending horizontally outwardly from an upper edge of said front and rear wall, respectively.

5. The sink of claim 4 wherein said first and second planar ledges extend a length of said side walls.

6. The sink of claim 5 wherein said third and fourth ledges extend a length of said front and rear wall, respectively.

7. The sink of claim 4 wherein said first ledge and said second ledge adjoin said third ledge and said first ledge and said second ledge adjoin said fourth ledge.

8. The sink of claim 7 wherein said faucet assembly further includes a spray nozzle.

9. The sink of claim 8 wherein said spray nozzle is positioned intermediate said spout and said control handle.

10. The sink of claim 4 wherein said first, second, third and fourth planar ledges are equal in length.

11. The sink of claim 10 wherein said sink is adapted to be installed in a counter having a square opening including right, left, front and rear sides.

12. The sink of claim 11 wherein said sink is adapted to be installed such that said first planar ledge with said faucet assembly is positioned against said rear side of said opening.

* * * * *